United States Patent [19]

Fukuhara et al.

[11] Patent Number: 4,917,787

[45] Date of Patent: Apr. 17, 1990

[54] METHOD FOR ON-LINE DECOKING OF FLAME CRACKING REACTORS

[75] Inventors: Akinoobu Fukuhara, Sagamihara, Japan; Gerard R. Kamm, Charleston, W. Va.

[73] Assignee: Union Carbide Chemicals and Plastics Company Inc., Danbury, Conn.

[21] Appl. No.: 39,756

[22] Filed: Apr. 16, 1987

Related U.S. Application Data

[63] Continuation of Ser. No. 547,016, Oct. 31, 1983, abandoned.

[51] Int. Cl.[4] .....C10G 9/12, C10G 9/16

[52] U.S. Cl. .....208/48 R 208/130, 208/106, 208/129; 585/950, 585/648, 585/650, 585/649, 585/652, 585/539, 585/541

[58] Field of Search ..... 585/648, 650, 950, 649, 585/652, 539, 541; 208/48 R, 130, 106

[56] References Cited

U.S. PATENT DOCUMENTS

| | | | |
|---|---|---|---|
| 2,371,147 | 3/1945 | Burk | 585/652 |
| 2,698,830 | 1/1955 | Jenny | 208/81 |
| 3,365,387 | 1/1968 | Cahn et al. | 208/48 R |
| 3,408,417 | 10/1968 | Sogawa et al. | 585/541 |
| 3,419,632 | 12/1968 | Sogawa et al. | 585/539 |
| 3,507,929 | 4/1970 | Happel et al. | 208/48 R |
| 3,557,241 | 1/1971 | Kivlen et al. | 585/950 |
| 3,565,970 | 2/1971 | Kelly | 585/952 |
| 3,641,190 | 2/1972 | Kivlen et al. | 585/950 |
| 3,674,679 | 7/1972 | Washimi et al. | 208/48 R |
| 3,795,713 | 5/1974 | Washimi et al. | 208/106 |
| 3,855,339 | 12/1974 | Hosoi et al. | 208/130 |
| 3,920,537 | 11/1975 | Walker | 208/48 R |
| 4,134,824 | 1/1979 | Kamm et al. | 208/130 |
| 4,136,015 | 1/1970 | Kamm et al. | 208/130 |
| 4,142,963 | 3/1979 | Kearns | 208/130 |
| 4,150,716 | 4/1979 | Ozaki et al. | 528/55 |
| 4,203,778 | 5/1980 | Nunciato et al. | 134/7 |
| 4,240,898 | 12/1980 | Gomi | 208/40 |
| 4,264,435 | 4/1981 | Read et al. | 208/130 |
| 4,321,131 | 3/1982 | Lowe | 208/130 |
| 4,376,694 | 3/1983 | Lohr et al. | 208/48 R |

FOREIGN PATENT DOCUMENTS

| | | | |
|---|---|---|---|
| 2028913 | 2/1971 | Fed. Rep. of Germany . | |
| 2923326 | 12/1980 | Fed. Rep. of Germany . | |
| 327438 | 2/1960 | United Kingdom | 585/539 |
| 827438 | 2/1960 | United Kingdom | 585/539 |
| 1306962 | 2/1973 | United Kingdom . | |

*Primary Examiner*—Chung K. Pak

*Attorney, Agent, or Firm*—Norman L. Balmer

[57] ABSTRACT

This invention relates to a method for on-line decoking of flame-cracking reactors whereby decoking is achieved without interruption of the normal operation of such reactors and without the necessity to change feed equipment and/or disassemble reactor components. While maintaining the temperature of the effluent at 1000° C. to 2000° C., the flow of the hydrocarbon feedstock in the reactor is periodically stopped for a time sufficient to reduce the carbon deposits to an acceptable level.

6 Claims, No Drawings

METHOD FOR ON-LINE DECOKING OF FLAME CRACKING REACTORS

This application is a continuation of prior U.S. application Ser. No. 547,016, filed Oct. 31, 1983, now abandoned.

TECHNICAL FIELD OF INVENTION

The present invention relates to a method for the efficacious decoking of flame cracking reactors without interruption of the normal operation of such reactors.

BACKGROUND OF THE INVENTION

During hydrocarbon cracking processes, carbonaceous deposits are formed on the reactor walls. Eventually, such carbonaceous deposits, if left to build to undesirable levels, can seriously restrict the flow of hydrocarbon vapors through the reaction zone vessel causing the pressure within the reactor vessel to increase to dangerous levels. Consequently, when a dangerous pressure level is reached, the reactor must be shut down. Many processes have been developed in the art of hydrocarbon cracking for dealing with this coking problem.

U.S. Pat. Nos. 3,557,241 and 3,365,387 disclose the introduction of sufficient steam and/or water to at least one tube of the cracking furnace while simultaneously reducing the hydrocarbon feed to that tube. The tube is then put back into service. The treatment of the tube is effected at temperatures ranging from as low as 370° C. (700° F.) to about 1100° C. (2000° F.). Such heat is supplied by external firing of the reactor tubes. Both Patents utilize a separate and distinct feed line for introducing steam and/or water for the so-called "on-stream decoking procedure". These lines are controlled by a valve which is put into service on only those occasions when the individual tube in question being decoked is undergoing such a cleaning operation.

While both Patents claim a multiplicity of tubes may be decoked at one time. U.S. Pat. No. 3,557,241, specifically states that it "contemplates the decoking of only a single tube at a time . . . " (Column 2. Lines 34–36), which is time consuming. Utilizing this method the furnace will be decoking during virtually all of its operational time. Furthermore, utilizing these two methods decoking a multiplicity of tubes at one time could cause a reduction in the production throughput of the system.

U.S. Pat. No. 3,920,537, deals with the coke deposition evolving from hydrocarbon cracking operations by "periodically contacting the coke deposit with a jet of relatively cold, high-pressure water." The Patent describes jetting the high-pressure cold water against the coke deposit in an amount sufficient to thermally shock and break up the coke deposit, typically at a pressure in excess of about 5000 pounds per square inch. This type of decoking technique, however, is only particularly useful where the coke deposition occurs on surfaces having temperatures of approximately 370° C. (700° F.) to 538° C. (1,000° F.).

German Patent Application No. 2923326 (See European Patent Application No. 0021167) discloses a method for decoking of equipment used in the thermal cracking of hydrocarbons which involves a two-step procedure utilizing steam and oxygen. The first step, involves conducting the gas flow of steam and oxygen through the equipment in an amount such that the temperature of the coke deposits on the heat exchanging surfaces of the cracking gas cooler are in the range of the prevailing thermocracking operating temperature. The second step involves intensifying the gas flow such that the temperature of the coke deposits on the heat exchanging surface of the cracking gas cooler is increased. Though this patent does involve a two step process, the second step merely involves the decoking of a separate piece of equipment e.g., the heat exchanger.

U.S. Pat. No. 4,203,778 effects decoking of furnace tubes by the use of a turbulent stream of impact resistant, non-angular, non-abrasive particles entrained in a gas stream. The particles are entrained at a concentration of 0.1 to 1.0 pound per pound of gas and the gas is introduced into the inlet end of the furnace tubes at a gas flow rate corresponding to an inlet velocity of 14,000 to 20,000 feet per minute.

The prior art decoking procedures in the hydrocarbon cracking field, operate under certain process constraints. The prior art utilizes decoking procedures wherein the reactors are made of metal. These processes are operated at reaction temperatures not exceeding about 1100° C. Because the reactors are made of metal, the heat for the decoking reactors are transferred through the walls. They usually require taking the reaction train equipment out of service and specially treating that equipment so as to reduce or eliminate the coking problem. Furthermore, in most cases, these processes require the dismantling of equipment or the addition of equipment in order to effect decoking. Such procedures are exceedingly time consuming, and add materially to the cost of the operation of the hydrocarbon cracking apparatus.

There have been developed in the art processes for cracking hydrocarbons which utilize a flame cracking reactor. Such a flame cracking reactor system is depicted in U.S. Pat. No. 4,136,015. In particular, this patent refers to the "Advanced Cracking Reactor" (ACR) process. As characterized in said patent:

> "In the 'Advanced Cracking Reactor' (ACR) process, a stream of hot gaseous combustion products is developed in a first-stage combustion zone. The hot gaseous combustion products may be developed by the burning of a wide variety of fluid fuels (e.g. gaseous, liquid and fluidized solids) in an oxidant and in the presence of super-heated steam. The hydrocarbon feedstock to be cracked is then injected and mixed in a second stage zone into the hot gaseous combustion product stream to effect the cracking reaction. Upon quenching in a third stage zone, the combustion and reaction products are then separated from the stream."

The ACR process is described in varying detail in the following patents: U.S. Pat. Nos. 3,408,417; 3,419,632; 4,136,015; 3,674,679; 3,795,713; 3,855,339; 4,142,963; 4,150,716; 4,240,898; 4,321,131; 4,134,824; and 4,264,435.

In addition to the aforementioned Patents which are specifically directed to the ACR process, other Patents directed to the cracking of hydrocarbons by a flame-cracking process include U.S. Pat. Nos. 2,698,830, 3,565,970 and 2,371,147.

In the operation of such flame-cracking processes for converting hydrocarbons into more volatile components, it is necessary to effect the reaction in a reaction zone that contains a protective surface of a high-temperature resistant material which is also resistant to the products of the reaction. Illustrative of such materials are graphite, silicon carbide, alumina, zirconia, magnesia, calcium oxide and the like. All of these materials are extremely resistant to high temperatures but have low thermal conductivity. The continuous operation of the ACR process and a flame-cracking reaction process in general, causes coke deposition on the reactor walls. For example, U.S. Pat. No. 4,136,015 utilizes a reaction zone in which the stream therein is maintained at supersonic velocity flows. Coke formation in a system such as this, will materially alter the nature of the flows, thereby rendering the reaction process less controllable.

There is described herein a process whereby the coking problem can be effectively controlled and which circumvent the physical limitations of the aforementioned ceramic linings, i.e., low thermal conductivity. Furthermore this invention provides a method of decoking without alteration or dismantling of the reaction assembly.

SUMMARY OF THE INVENTION

This invention is an improvement in the continuous process of cracking hydrocarbon feeds in a flame cracking reactor.

This invention involves a method for effecting on-line decoking during a flame-cracking reaction such as that embodied in the ACR process. Processes such as the ACR, involve the combustion of a carbonaceous or hydrogen-containing fuel with oxygen and the resulting combustion product stream is mixed with superheated steam to produce a heat carrier. The heat carrier is contacted with converging hydrocarbon feedstock streams in a zone juxtaposed and openly connected to the zone in which the flame is formed. The mixture is then passed into an reaction zone wherein cracking takes place. Carbon deposits are formed on the reactor walls during the operation of the reactor.

This invention involves periodically stopping the flow of hydrocarbon feedstock streams utilized in the flame cracking reaction process (e.g., the ACR process) while maintaining the temperature of the heat carrier flow to the reactor at an appropriate rate and at about 1000° C. to 2000° C. for a period of time sufficient to reduce the carbon deposits to a predetermined level. The combustion gases may be produced by burning a fuel derived from the products of the cracking process or an alternative process fuel. The normal operation of the process may then resume by restarting the flow of feedstock and re-adjusting the combustion products to their normal flow and temperature.

The removal of certain deposits, commonly referred to as decoking, is carried out by periodically adjusting the fuel rate or the oxygen rate or the fuel to oxygen ratio to produce combustion products which have the desired composition and properties of temperature and velocity. Additionally, the steam rate can be changed to modify the operating temperature and velocity. The mixture of combustion products and steam constitute decoking gases.

At the start of the decoking operation, the hydrocarbon feed rate is lowered to a level consistent with the decreased burner flow. The feedstock stream is then completely stopped for a period sufficient to reduce the carbon deposits to an acceptable level for continued operation. Once the decoking operation is completed, the normal hydrocarbon feed rate is resumed and the cracking operation is continued.

The method of this invention, as compared to conventional decoking methods, has the advantage of allowing the operated machinery to be completely decoked in a short amount of time. i.e., usually three hours or less. Thus, it does not require the removal of downstream equipment and the reactor need not be disassembled, mechanically altered, or connected to additional equipment.

DISCUSSION OF THE INVENTION

The operation of the flame-cracking reaction is well described in the references previously cited. It is the purpose of this invention to eliminate a problem which occurs during their continued operation: The coke formation that results during the normal period of operation of these processes.

It is well known that carbon can react with a number of chemicals which are present during a high-temperature hydrocarbon cracking reaction. Carbon, for example, will react with water to form carbon monoxide and hydrogen. It reacts with carbon dioxide to form carbon monoxide. Furthermore, carbon can be hydrogenated to methane by reaction with hydrogen and can be oxidized to carbon dioxide and carbon monoxide by reaction with oxygen. It is the purpose of this invention to utilize all of these known chemical reactions to remove the carbon that has been deposited within and ACR or a typical flame-cracking process reactor.

The problem of effectuating carbon removal in the instant case is not as simple as the application of the known chemical reactions stated above. During the operation of flame-cracking reactors such as the ACR reactor, in particular, the temperature of the reaction zone ranges as high as 2000° C., and even higher. As the temperature within a reactor of this nature increases, carbon depositions along the wall can become more graphitic in nature and consequently, a layer of carbon which is remarkably resistant to chemical reactions can form. Indeed, such graphitic carbon could be used as an insulating layer for such a reactor. The term graphitic carbon is intended to include carbon which has undergone a sufficient amount of heat treatment such that its crystalline structure becomes either graphite-like or as that of pure graphite.

The deposited coke can be eliminated by flowing a hot steam containing stream (such as steam) over it for a time sufficient to convert at least a portion of said coke to a gaseous material by chemical reaction. This can be best accomplished by controlling the temperature and velocity of the gaseous stream formed by the burning of carbonaceous or hydrocarbon-containing fuel, and transporting those combustion products to the reaction zone. Simultaneously, the temperature of the reaction zone must be maintained at 1000° C. to about 2000° C. for a period of time sufficient to effectively reduce the carbon deposit. Preferably, the velocity of the stream in the reaction zone should be such as to provide a carbon removal rate sufficient to meet the process requirements of a typical hydrocarbon cracking commercial facility. Minimally, the combustion product velocity should be such as to provide for stable combustion of the carbonaceous or hydrocarbon-containing fuel. The maximum velocity preferred would be a supersonic velocity within the reaction zone.

In the preferred operation of the process, a higher velocity gas stream is preferred for carbon removal. It is believed that such a high velocity stream enhances the gasification of the carbon and also enhances the physical removal of particulate carbon from the surface of the reactor walls.

The primary chemical reaction relied upon for carbon removal in the practice of this invention is carbon gasification: the reaction of carbon with steam to form carbon monoxide and hydrogen. This reaction to be most effective requires the presence of enough steam within the combustion zone to efficaceously remove the deposited carbon. In the typical case, the amount of steam which is present should be at least approximately 10 weight percent versus the weight of the stream fed to the reaction zone. This amount can be reduced should the velocity of that stream be increased. However, the amount of steam can exceed 10 weight percent and can be as high as 100 percent of the weight of the stream, e.g., use of hydrogen as a fuel for producing the hot gaseous stream will provide that the stream is all water/steam. This mechanism provides for the actual physical removal of carbon by spalling and thermoshock techniques which will be discussed below.

Where the carbon deposit becomes graphitic, carbon removal might necessitate more severe treatment such as, the utilization of gas streams with higher concentrations of steam and the operation of such streams at higher velocities and temperatures to induce cracks within the carbon structure which greatly increase the gasification rate by providing more surface area per unit volume. Additionally, these cracks enhance the potential for the flaking away of the carbon deposit from the reactor walls. In the art, this phenomena is referred to as "spalling".

The elimination of carbonaceous deposits by spalling results from the achievement of a thermal gradient across the carbon thickness. A natural temperature gradient exists throughout the coke and the reactor walls and by quickly increasing the temperature of the decoking gases, this temperature gradient is increased. Gases with higher temperatures and velocities will tend to cause more spalling as well as faster chemical reaction rates. A high temperature gradient can be achieved by a rapid rise in the temperature of the decoking gases in the reactor, that is, bringing the reactor to a maximum decoking temperature during a short period of time. This greatly enhances the spalling effect, causing thermal stress in the form of cracking within the coke; thereby, allowing it to more readily react with the steam and other reactants present in the decoking gas.

DETAILED DESCRIPTION OF INVENTION

In order to describe the invention, references will be made to the drawings in U.S. Pat. No. 4,136,015 which graphically and schematically depict an ACR reaction assembly. In particular FIG. 3, thereof, shows a cross-sectional view of the critical components typically found in an ACR reactor.

A cracking reactor utilizes the heat of combustion of a carbonaceous or hydrogen-containing fuel with oxygen, either as pure oxygen gas, air, or oxygen mixed with other gases, to heat a hydrocarbon feedstock to its appropriate cracking temperature. The combustion fuel may comprise, for example, the gases produced by the high-temperature partial combustion of coal or coke with oxygen, or any fluid hydrocarbon material such as natural gas and/or hydrogen. These fuels and their combustion products are well-known in the art.

The combustion products can be formed by mixing a gaseous hydrocarbon, or hydrocarbon mixtures with oxygen utilizing a metal burner with a gas combustion chamber assembly. The combustion gases may be produced by burning a fuel derived from the products of the cracking process or an alternative process fuel. The hydrocarbon feedstock thereafter is introduced into the reactor, in a mixing zone, typically in a direction angular to the flow of the combustion product stream. This admixing occurs preferably, in a direction not only angular but countercurrent to the direction of the product stream. The angular introduction of the hydrocarbon feed is described in particular in U.S. Pat. Nos. 4,142,963, 3,674,679, 3,408,417, 3,419,632.

U.S. Pat. Nos. 3,855,339, and 4,136,015 both specifically apply to feeding the hydrocarbon feed into the reactor in the form of an atomized spray of liquid droplets in a manner such that said material is linearly injected in a radial direction towards the center axis of the reactor, and countercurrently at an angle of 120° to 150° to the passing direction of the heating medium stream which is the combustion gases.

In practicing the preferred embodiment of the ACR process, the hydrocarbon feed to be cracked is enveloped in a steam shroud, which not only enhances the introduction of the feed to the reaction zone but also protects the metal injectors and inhibits carbon deposition at the feed inlet points. The feed and the combustion product stream are thoroughly intermixed and fed through the constricted throat into the diffuser/reactor portion of the ACR reactor. The velocity of the stream through the throat is preferably sonic velocity and develops supersonic velocity upon exit from the throat in the diffuser/reactor section; all of which is described in considerable detail in U.S. Pat. No. 4,136,015. The effluent from the diffuser/reactor section as shown in FIG. 1 of U.S. Pat. No. 4,136,015 enters the quench zone, whereupon the reaction is stopped and product recovery begins. This is more specifically described in U.S. Pat. No. 4,150,716.

The fuel which is utilized to form the combustion product stream is typically a mixture of hydrogen and methane. Typically, the oxidant is essentially pure oxygen. This combination is reacted and then moderated by the addition of steam diluent to achieve a combustion product stream having a temperature of about 1600° to about 2400° C. The combustion product stream is thereafter contacted with the hydrocarbon feedstock which is fed in an essentially countercurrent direction to that of the combustion product streams through a number of injectors which openly connect to the interior of the ACR. Each of these injectors is surrounded by concentric annular feed zones which introduce the steam shroud which circumscribes the hydrocarbon feed. The shrouded hydrocarbon feedstock stream mixes with the combustion product stream slightly above a throated section within the ACR. This is more specifically described in FIG. 3 of U.S. Pat. No. 4,136,015 and FIG. 1 of U.S. Pat. No. 4,142,963. An illustration of specific injector arrangements utilized for the introduction of the hydrocarbon feedstock and its steam shroud can be found in FIGS. 3*a*, 4*a*, and their corresponding FIGS. 3*b* and 4*b* of U.S. Pat. No. 4,142,963. The operative conditions by which such a reaction is carried out are fully described in U.S. Pat. No. 4,136,015.

The mixture of feedstock, combustion product stream and shroud steam flow through the throated section of the ACR reactor to obtain sonic velocity and thereafter issue into the diverging supersonic velocity diffuser/-reaction zone wherein the cracking reaction to produce the more volatile products is effected. It is within the expanded reaction zone and the throated zone that the carbon deposits develop in quantities sufficient to eventually adversely affect the overall process.

The process of this invention most efficiently removes deposited carbon products within the aforementioned zones in a manner which does not require any dismantling of apparatus or the inclusion into the apparatus of other equipment. The process of this invention allows one to utilize the ACR process, for example, without having to make any changes in any of the downstream apparatus normally associated therewith. In the typical case, no uncoupling of downstream equipment is necessary during the decoking operation as herein described.

In carrying out this preferred embodiment, the temperature which is achieved in the combustion reaction is from about 1000° C. to about 2400° C. These unusually high temperatures would necessitate a lining capable of withstanding these high temperatures.

In the practice of this invention, it is preferable to maintain the highest concentration of oxygen allowable so as to enhance the rate of decoking by the reaction of such oxygen with the coke. The concentration of oxygen is limited by safety considerations such as the flammability of the overall mixture.

The preferred embodiment of the present invention involves the practice of a two stage method. The decoking is begun by reducing the burner flow capacity to approximately 70% of its usual mass flow rate, while maintaining the reactor at a temperature between approximately 1150° C.-1200° C. for a two hour period. The burner flow capacity is actually the mass flow rate of the high temperature gas used in normal operation.

When utilizing this preferred embodiment, a steam purge is normally put through a metal steam curtain just upstream of the quencher to protect it from high temperatures. Once the inlet pressure is reduced to lower levels, indicating that decoking has been completed in the reactor, throat and diffuser the burner flow capacity is raised in the second stage of the process to approximately 90% and the decoking temperature is increased to 1300° C. for a period of one hour. The steam purge to the quencher is then simultaneously decreased. It is this downstream decrease in the steam purge to the quencher that allows the quench zone to be decoked.

As the coke deposition increases, the diameter of the throat decreases, and the overall area of the reactor/diffuser section is reduced. Consequently, it is possible thereby, with reduced velocity in the combustion gas stream to maintain the sonic conditions in the throat and supersonic conditions in the reactor/diffuser section.

Utilizing the combustion products stream which has an extremely high temperature will, of course, enhance the gasification of the coke deposited on the reactor walls. However, such high temperatures can adversely affect the ceramic lining of the reactor and, therefore, in choosing the conditions at which the decoking process is operated, it is necessary to take into consideration the issue of mechanical integrity. The most preferred method of effecting coke removal is to utilize he most stringent conditions in terms of temperature, steam concentration, and the like that the particular reactor assembly will accept. This then allows for decoking in the shortest period of time.

An alternate embodiment of the present invention involves the practice whereby decoking is achieved by reducing the burner flow capacity to approximately 55%. The reactor temperature is maintained between approximately 1150° C.-1200° C. for the entire decoking period. A steam purge is put through the quencher steam curtain to protect it from high temperatures and said steam purge remains at this level throughout the entire decoking process.

Another alternate embodiment of the present invention involves a two stage process whereby different temperature levels are utilized to facilitate the decoking process. The burner flow capacity is reduced to approximately 70% while maintaining the reactor at a temperature between approximately 1350° C.-1400° C. Utilizing this alternate embodiment, a steam purge is put through the quencher steam curtain to protect it from high temperatures. The reactor is maintained at this temperature for a period of time sufficient to detect a noticeable decrease in the pressure, indicating the decoking process is almost at completion, in this instance usually about thirty minutes. The reactor temperature is then elevated to approximately 1450° C. for the remainder of the decoking period, approximately one hour.

EXAMPLES

EXAMPLE 1

A pilot-scale flame-cracking ACR reactor, with an ethylene capacity of 250,000 lbs./yr., is operated with a whole distillate of Arabian Light crude as the feedstock. A "whole distillate is a blend of the overhead product from the atmospheric and vacuum distillation of a crude oil," i.e. a crude oil minus the residual oil obtained following vacuum distillation. The burner uses essentially pure hydrogen and oxygen; steam is added to moderate the temperature of the combustion products. Thus the effluent from the burner consists mainly of superheated steam with small amounts of unconsumed hydrogen. The reactor exit pressure is kept at 50 psig. At the beginning of the run, the required inlet pressure to the reactor is 59 psig. Over a period of about six hours run time, the inlet pressure gradually increases to about 77 psig, indicating the coke is depositing and is restricting the reactor.

To decoke the reactor, the burner is first adjusted to conditions which would result in a reactor temperature of approximately 1200° C. if no feed were being injected. Feed to the reactor is stopped, and the reactor pressure is reduced to about 30 psig and held constant. Total burner effluent is reduced to about 66 percent of normal operating rates. Without feed injection to absorb the endothermic heat of reaction, the reactor temperature rises to about 1200° . At the start of the decoking process, the inlet pressure is about 54 psig; after about 10 minutes of decoking, the inlet pressure decreases to about 45 psig indicating that the coke is being removed. Further operation does not result in another decrease in inlet pressure, indicating that all the coke has been removed.

At this point the reaction could have been reinstated by reversing the above procedure. However, the reactor is shut down and disassembled for inspection. The ceramic lining of the reactor is found to be clean and substantially, free of traces of coke. No damage to the reactor resulted from the decoking. Had the reactor been decoked according to the prior art, the process would have taken at least two days and the coke would not have been removed as completely as accomplished by the invention.

EXAMPLE 2

An ACR with an ethylene capacity of 5,000,000 lbs/yr is operating with vacuum gas oil as cracking feestock. The burner fuel is a mixture of gaseous hydrocarbons and hydrogen, which is burned in substantially pure oxygen. Steam is added to moderate the burner temperature. About five percent more than the stoichiometric quantity of fuel is used, so the burner effluent consists mainly of high temperature carbon oxides and steam, with a small amount of unconsumed fuel. The reactor outlet pressure is kept at about 40 psig. At the start of the run, inlet pressure is about 68 psig; during the course of several days operation, inlet pressure gradually increases to about 74 psig, indicating that coke is depositing in the reactor.

To decoke the reactor, first the feed and burner are adjusted to about half the normal flow rates. The feed is then turned off completely, and the burner adjusted to obtain a temperature in the reactor of about 1150° C. to 1200° C. A steam purge of about 500 lb/hr is put through the quencher steam curtain to protect it from high temperatures. The reactor is maintained at these conditions for approximately three hours. At the end of that time, the process is reversed and the reactor is returned to normal operating conditions. The inlet pressure to the reactor has returned to about 68 psig, demonstrating that the coke has been removed.

During the decoking process, the downstream processing equipment, such as the gasoline fractionator, is kept in standby mode. The decoking period is so short that the downstream equipment is easily returned to normal operating conditions, with very little upset to the overall process.

EXAMPLE 3

The reactor is operated and coking occurs as described in Example 2. The decoking process is conducted similarly, except that the temperature in the reactor is adjusted to about 1350° C. to 1400° C. and the decoking is only carried out for about 30 minutes. The steam purge through the quencher curtain as in Example 2 is used to protect the quencher. After decoking, the reactor inlet pressure has again returned to its usual level, demonstrating that the coke has been removed. Coke chips are later discovered in a downstream strainer, indicating that some of the coke has been removed either by spalling, or by the mechanical force of the decoking gas stream.

EXAMPLE 4

The reactor is operated and coking occurs as described in Examples 2 and 3. The decoking process is conducted at about 1150° C. to 1200° C. for about two hours, and then at about 1350° C. to 1400° C. for about one hour. After decoking, the reactor is returned to normal operating conditions by reversing the process, and the inlet pressure returns to its normal level. During this entire process the quencher steam purge remains constant at 500 lbs/hr. No coke chips are discovered in any downstream equipment, indicating that the bulk of the coke was removed by chemical reaction in the first two hours of the process. This avoids any possible problems of coke chips clogging downstream equipment. The final hour at a higher temperature ensures that any traces of coke which are especially resistant to chemical reaction are removed, because reaction rate increases greatly with a 200° C. increase in temperature.

EXAMPLE 5

The reactor is operated as described in Example 2. After several days of operation, the inlet pressure increases to about 74 psig. In addition, the pressure drop across the quencher increases from its normal value of about 5 psi to about 15 psi, indicating that coke is depositing in the quencher. Decoking is begun with a reactor temperature of about 1150° to 1200° C. A steam purge of about 500 lb/hr is put through the quencher steam curtain to protect it from high temperatures.

At the beginning of the decoking, the pressure drop across the quencher is about 10 psi. After about two hours of decoking, the pressure drop across the reactor has dropped to a level indicating that the reactor is effectively decoked. The pressure drop, however, across the quencher remains about 10 psi. At this point, the decoking temperature is increased to about 1350° C. to 1400° C. and the steam purge to the quencher is decreased to 140 lb/hr. This decrease in the steam purge to the quench zone enables said zone to be effectively decoked. The pressure drop across the quencher begins to decrease almost immediately, indicating that coke is being removed. The reactor is decoked for about another hour at these conditions. After a total of about three hours decoking, the process is reversed and the reactor is returned to normal operating conditions. Inlet pressure to the reactor has returned to about 68 psig, and pressure drop across the quencher has decreased to the original 5 psig, demonstrating that the reactor and quencher have been effectively decoked.

Examples 2, 3 and 4 illustrate three possible embodiments of the invention for decoking the reactor. Any of these three methods or some modification of these methods may be used depending upon the circumstances. Example 2 describes a method which is unlikely to cause excessive reactor wear because the temperatures never exceed about 1200° C. Example 3 is effective in a shorter period of time, but causes some coke chips to be carried out of the reactor into the downstream equipment. This may result in faster reactor wear because of the use of higher temperatures. Example 4 eliminates the problem of the coke chips and because of the increased temperature (for the last part of the cycle), is very effective at removing the last vestiges of coke. However, this method requires more time than the method of Example 3, and it exposes the reactor to higher temperatures than the method of Example 2. The method of Example 2C is thought to be the most preferred embodiment at this time, but the other methods are acceptable and may be preferred in some circumstances.

Example 5 illustrates how the invention can be extended to the decoking of downstream equipment which is not normally thought of as part of the main reactor section. The decoking gases are conducted through that equipment and the temperature there is adusted. The method of Example 5 is identical to that of Example 4, except that the flow of purge steam through the quencher curtain just upstream of the quencher is reduced, allowing the temperature in the quencher to rise to the level necessary for effective decoking.

We claim:

1. In a continuous process for cracking hydrocarbon feeds in a flame-cracking reactor wherein carbonaceous or hydrogen-containing fuel and oxygen are combusted to form a combustion product which is admixed with superheated steam to produce a heat carrier, and the heat carrier is contacted with converging hydrocarbon feedstock stream and passed to a reactor wherein cracking of the feedstock takes place and carbon deposits on walls defining the reactor, the improvement which comprises periodically stopping the hydrocarbon feedstock stream, providing the heat carrier at a temperature of from about 1250° C. to 1600° C. said heat carrier comprising at least about 10 weight percent steam, and introducing the heat carrier into the reactor for a period of time sufficient to reduce the carbon deposited.

2. The process of claim 1 wherein the fuel is supplied from a source totally independent from the flame-cracking process.

3. The process of claim 1 wherein the ratio of fuel to oxygen is adjusted so that the heat carrier includes oxygen.

4. In a continuous process for cracking hydrocarbon feeds in a flame-cracking reactor wherein carbonaceous or hydrogen-containing fuel and oxygen are combusted to form a combustion product which is admixed with superheated steam to produce a heat carrier, and the heat carrier is contacted with converging hydrocarbon feedstock stream and passed to a reactor wherein cracking of the feedstock takes place and carbon deposits on walls defining the reactor, the improvement which comprises periodically stopping the hydrocarbon feedstock stream, providing the heat carrier at a temperature of from about 1000° C. to about 1250° C., said heat carrier comprising at least about 10 weight percent steam, introducing the heat carrier into the reactor for a period of time sufficient to remove a substantial amount of the carbon deposited, then quickly providing the heat carrier at a sufficiently higher temperature in the range of about 1250° C. to induce spalling of the carbon deposited and to remove further amounts of the carbon deposited.

5. The process of claim 4 wherein the fuel is supplied from a source totally independent from the flame-cracking process.

6. The process of claim 4 wherein the ratio of fuel to oxygen is adjusted so that the heat carrier includes oxygen.

* * * * *